US006820399B2

(12) United States Patent
Send

(10) Patent No.: US 6,820,399 B2
(45) Date of Patent: Nov. 23, 2004

(54) METHOD AND DEVICE FOR POSITIONING A WEB OF FILM OF A PACKAGING DEVICE

(75) Inventor: Dietmar Send, Durach (DE)

(73) Assignee: CFS Germany GmbH, Biedenkopf-Wallau (DE)

( * ) Notice: Subject to any disclaimer, the term of this patent is extended or adjusted under 35 U.S.C. 154(b) by 0 days.

(21) Appl. No.: 10/432,475

(22) PCT Filed: Nov. 19, 2001

(86) PCT No.: PCT/EP01/13353

§ 371 (c)(1),
(2), (4) Date: Oct. 10, 2003

(87) PCT Pub. No.: WO02/42161

PCT Pub. Date: May 30, 2002

(65) Prior Publication Data

US 2004/0123568 A1 Jul. 1, 2004

(30) Foreign Application Priority Data

Nov. 24, 2000 (DE) ..... 100 58 576
Dec. 27, 2000 (DE) ..... 100 65 389

(51) Int. Cl.[7] ..... B65B 7/28

(52) U.S. Cl. ..... 53/471; 53/51; 53/64; 53/398.2; 493/10; 493/11; 493/13

(58) Field of Search ..... 53/51, 64, 67, 53/75, 282, 229.4, 559, 374.4, 389.2; 493/10, 11, 13, 14, 15, 17, 18

(56) References Cited

U.S. PATENT DOCUMENTS 3,140,573 A * 7/1964 Buttolph ..... 53/51
3,374,602 A * 3/1968 Hamilton ..... 53/51
3,411,767 A * 11/1968 Moser et al. ..... 270/52.07
3,427,778 A 2/1969 McCluskey ..... 53/3
3,589,095 A * 6/1971 James et al. ..... 53/51
3,652,363 A * 3/1972 Kinslow, Jr. ..... 156/361
3,762,125 A * 10/1973 Prena ..... 53/51
3,762,617 A * 10/1973 Matthis ..... 226/32
3,861,983 A * 1/1975 Harrell ..... 156/361
3,979,877 A 9/1976 Vetter ..... 53/51
5,067,307 A * 11/1991 Francioni et al. ..... 53/450
5,230,205 A * 7/1993 Hautemont ..... 53/485
6,021,629 A * 2/2000 Sterner, Sr. ..... 53/471
6,033,502 A * 3/2000 Coenen et al. ..... 156/64
6,109,000 A * 8/2000 Conti ..... 53/51

FOREIGN PATENT DOCUMENTS

DE 4041547 A1 8/1991
EP 1160167 A3 12/2001

* cited by examiner

*Primary Examiner*—Eugene Kim
*Assistant Examiner*—Hermant M Desai
(74) *Attorney, Agent, or Firm*—Perman & Green, LLP

(57) ABSTRACT

The invention relates to a method for positioning webs of film of a packaging device, according to which goods are introduced into a first web of film in troughs, a second web of film is withdrawn from a supply of web against the resistance of a brake and is placed on the first web of film and interlinked with the same, the advance of the second web downstream of the supply of web being detected by a first optical recognition means. In order to exactly position the two films one on the other, a second recognition means is provided that detects any dimensional errors, thereby changing the position of the first recognition means relative to the direction of conveyance of the second web of film.

9 Claims, 1 Drawing Sheet

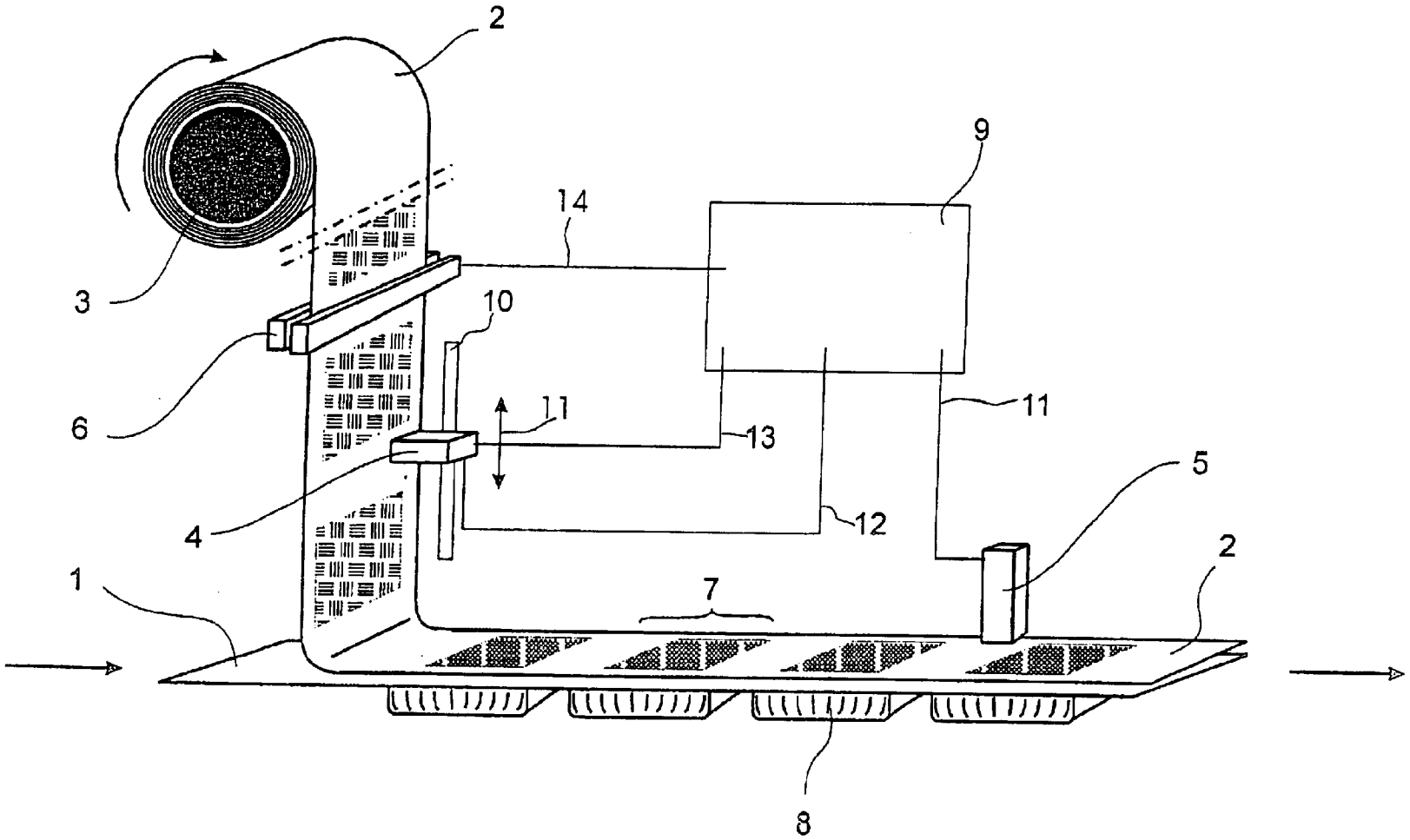
1
2
3
4
5
6
7
8
9
10
11
12
13
14
2
11

METHOD AND DEVICE FOR POSITIONING A WEB OF FILM OF A PACKAGING DEVICE

This application claims the benefit of the earlier filed International Application No. PCT/EP01/13353, International Filing Date, Nov. 19, 2001, which designated the United States of America, and which international application was published under PCT Article 21(2) as WO Publication No. WO 02/42161 A1.

BACKGROUND OF THE INVENTION

The invention relates to a method for positioning webs of film of a packaging device, according to which goods are introduced in a first web of film moving in the advance direction in troughs in this first web of film and then a second web of film is withdrawn from a supply of web against the resistance of a brake and is placed on the first web of film and bound with the same with the advance of the second web of film downstream of the supply of web being detected by a recognition means and set by varying the brake force of the brake in dependence on the signal from the recognition means so that in each case a repeat as a defined area of the second web of film comes to lie on the troughs in the first web of film. In addition, the invention relates to a packaging device for the performance of this method.

A method of this kind or a packaging device of this nature is generally known. Here, the first web of film is provided with the troughs into which the goods to be packed are introduced. Then, the second web of film is placed on this first web of film provided with the goods and welded thereto, either using vacuum technology or with inclusion of air, for example in a sealing station. Subsequently, the individual troughs with the surrounding area of film are separated from each other and in this way individual items of goods packages are produced. This packaging method is frequently used for foodstuffs, but may also be used for other goods. For the inscription of the packaging, generally the second web of film is imprinted, with this frequently taking place completely so that, for example, the packed goods may be protected against UV light. The imprint is divided into repeats according to the packaging length so that one repeat comes to lie over each trough.

For purposes of appearance and to guarantee an airtight welding, the top, second web of film is preferably under tension so that no folds occur during the later packaging. For this, the second web of film is withdrawn from a supply, which may, for example, be formed from a roll, against the restraining force of an adjustable brake. The second web of film, which is under tension, is then placed on the first web of film by means of guides and then welded, whereby adjustment of the brake force may be used to set the position and extension of the flexible web of film. In practice, for example, the imprint should be performed so the desired image only appears after a certain pretension of the second web of film.

The position of the individual repeats is detected by a recognition means, whereby a regulator may be used to set the brake force so that the rate of advance of the second web of film may be matched to that of the first web of film.

SUMMARY OF THE INVENTION

Although this is adequate for the general control of packaging machines, it has been found that slight positional deviations are frequently possible so that the repeats do not come to lie one hundred percent exactly over the troughs. In particular with packaging which is to be printed right up to the edge, this has been found to be disadvantageous since, on the one hand, the goods packaged in this way give a poorer impression of quality and, on the other, the positional deviation may mean that necessary information is no longer on the actual packaging, but is cut off during the later cutting process and so the goods are no longer marketable. For example, information such as the use-by date of a foodstuff or the weight must under no circumstances fall out of the area of the later packaging.

Therefore, it is the object of the invention to create a method for the positioning of the web of film and a packaging device for the exact and simple positioning of the repeats of the second web of film over the troughs of the first web of film.

This object is achieved according to the invention in that a second recognition means determines the exact position of the repeat relative to the first web of film and, in the event of dimensional errors, adjusts the position of the first recognition means relative to the direction of conveyance of the second web of film.

By way of the embodiment of the packaging method according to the invention, it is now possible to define an exact position by means of the second recognition means. If it is hereby determined that the position deviates from the set position, a regulating intervention will be performed by means of changing the position the first recognition means.

By way of the embodiment according to the invention it may be achieved that, by means of the control of the actual condition by the second recognition means, the position of the first recognition means is changed relative to the direction of conveyance of the second web of film. The result of this is that, due to the control circuit comprising the first recognition means and the brake force, the control circuit is correspondingly influenced. For example, if the second recognition means determines that the repeat is slightly ahead of the required position, i.e. has come to lie slightly ahead of the troughs, the front part of any printed image applied would be cut off. In this case, the position of the first recognition means is oriented backwards, which means changed against the direction of conveyance of the second web of film whereby the first recognition means records the repeat correspondingly earlier and then actuates the brake correspondingly more powerfully in order, by means of withdrawing less of the second web of film, to correct the position of the second web of film over the first web of film as appropriate.

The suggested method is in particular performed with packaging devices which operate fully automatically. However, the method is suitable in the same way, to be used in other manufacturing processes, for example, which in particular involve positioning two films one on the other. Usually, the first web of film, which takes the goods to be packaged, is described as the bottom web and the second web of film, which seals the troughs, is usually described as the top web.

The suggestion according to the invention achieves a self-adjusting system. When setting the machine, the top web no longer needs to be arranged with high precision in relation to the bottom web since the two recognition means in conjunction with the stepped intervention in the control circuit in question and the brake and the film's intrinsic elasticity achieve the relevant positioning of the top web on the bottom web. Therefore, the process runs fully automatically.

However, the suggestion according to the invention not only accelerates a format change, the amount of adjustment work required is reduced by the suggestion according to the invention, it also provides greater stability during the operation, since it is been found that the tensile stress of the web of film withdrawn from a supply of web is not always identical during the process. For example, after production, the film is wound on a reel whereby once again the web is slightly stretched or wound on under tension. This dimension is not always identical along the direction of conveyance which means that a certain offset of the repeat takes place, even if the repeat was aligned exactly on the trough at the start. This effect is also automatically compensated by the suggestion according to the invention. As a result, the invention achieves less manual or personal positioning work when changing a web of film and higher stability, i.e. constant packaging quality.

Due to its intrinsic elasticity, the web of film may be offset to a certain degree by actuating the brake or releasing the brake so that on a relevant signal from the first recognition means, the controller may perform a control intervention. If the second optical recognition means recognises a positional deviation of the repeat of the second web of film relative to the trough in the first web of film, the first recognition means is slightly offset in such a way that the brake is either (slightly) released or prematurely applied more powerfully. If the brake is released, the elasticity of the film will ensure that the repeat is pulled forward slightly.

On the other hand, it is possible for the second web of film to follow the advance of the first web of film, i.e. for the repeat to be arranged slightly downstream of the position of the trough. In this case, the brake may be released, with a constant withdrawal force the rate of advance of the second strip of film will increase and hence the after-running will be made up again.

Here, it is possible to achieve a correction or exact positioning of the web of film either by means of its own elasticity, which obviously can only be stretched as far as its tensile strength, or, however, in that the advance or brake for the web of film are controlled so that—without additionally exploiting the elasticity—the relative position of the top web of film on the web of film with the troughs is changed. Once again, this makes it possible to change the relative position of the first recognition means in the direction of conveyance of the second web of film.

To perform the said method, the recognition means must be able to determine the position of the repeat, which advantageously takes place by means of so-called control marks which the recognition means can differentiate from the remaining area of the web of film. Control means of this type could, for example, be (optical) markings on the web of film, however it may also be possible for the position of the repeats to be identified using certain imprints. The recognition of the position, in particular the position of the bottom strip of film from edges or other significant parts of the films is also possible. As an alternative to the use of optical, i.e. visible control marks, however, it is also possible for invisible markings, for example ultraviolet reflecting control marks etc. to be provided. Advantageously, obviously, the embodiment of the recognition means is matched to the control marks. However, it is also possible instead of recognition means to use other sensors such as, for example, Hall sensors or sensors which work in a different way, which are sensitive to suitable means used as control marks on the web of film.

The optical recognition means may be simple photocells which respond to a specific signal strength. Here, the light required to switch on the photocell may fall on the cell as either reflected or transmitted light. With a transparent packaging, for example, a beam of light, which may comprise a weak laser beam, may shine through the packaging, i.e. through the first and second webs of film, so that when a recognition mark is passed, this beam is interrupted for a defined time. With this embodiment, it is possible to provide a recognition mark on both the first and second webs of film.

To make it possible to distinguish which control marks belong to which web of film, the control marks may have different extensions so signals of different lengths are generated by the photocell. The embodiment of the method according to the invention means it is now possible not only to detect and regulate the rate of advance of the second strip of film by the first recognition means, but also to determine the relative position of the first strip of film relative to the second strip of film by means of the second recognition means.

In a preferred embodiment of the invention, it is provided that the second recognition means itself comprises several sensors arranged at intervals (in the direction of conveyance). An arrangement of this kind is, for example, favourable if the rate of conveyance is not known exactly and the second sensor can measure the speed or time and hence also the offset. Usually, the offset of the first recognition means is otherwise determined from the known direction of conveyance; for this, the recognition means supplies only one time value for this offset.

Instead of the photocells, other optical recognition means, for example, a line camera or another type of camera, may be used. The increasingly faster image processing enables a camera at a defined position to detect the second strip of film from above and, if the imprinting on the second strip of film so permits, also to determine the position of the underlying first strip of film. If, on the other hand, it is not possible to shine light through the second strip of film, the underlying first strip of film may also be detected by the use of a second camera. A subsequent evaluation of the image then permits the exact determination of the position of the two strips.

The second strip of film is usually imprinted with information relating to the goods to be packaged and with advertising motifs. However, it is also possible for this second strip of film not to be imprinted and to comprise either a transparent or a non-see-through, in particular a coloured, plastic. In these cases, the control mark may take the form of additional aids such as, for example, lines or other selectively arranged optical defects. For example, the repeat may be characterised by a local change in the reflection properties. A change of this kind may be achieved, for example, by applying a matt finish to an otherwise glossy surface. It is also, for example, possible to provide a reflector layer activated by ultraviolet radiation as a control mark.

In a further preferred embodiment of the packaging device, the welding device, which after the alignment of the first web of film relative to the second web of film seals the trough by bonding the two webs of film at sealing station, is triggered by the second optical recognition means. This means that the welding process is only triggered if the second optical recognition means indicates to the controller that the alignment of the two webs of film relative to each other corresponds to the specified condition. This automatically prevents inaccuracies occurring during the packaging.

In order to enable the packaging device to be adjusted for a plurality of possible dimensions, preferably the position of the first and the second recognition means is adjustable in the advance direction. The further development according to the invention ensures that the device may be converted for other repeat or packaging trough lengths in a simple way. Advantageously, this adjustability is monitored electronically and controlled mechanically or electromechanically. The position in the direction perpendicular to the advance motion may also be adjusted, thus enabling different widths of the webs of film to be processed.

It is suggested according to the invention that the second recognition means is arranged either upstream or downstream of the sealing station. The advantage of an arrangement downstream of the sealing station is that here the top and bottom webs are already welded together and the actual condition, namely the condition of the finished packaging, may be reliably checked. Here, the disadvantage is the fact that the packaging is already closed and is possibly to be treated as scrap. Conversely, the use of the second recognition means upstream of the sealing station permits a certain possibility for correction so that the films in the sealing station are bonded correctly.

The advantages of bonding the second web of film, i.e. the top web, with the first web of film under tensile stress have already been referred to in the introduction. This avoids the formation of folds or waves.

In a preferred embodiment of the invention, it is provided that the degree of the positional correction of the first recognition means substantially corresponds to the dimensional error determined by the second recognition means. Here, an interval of approx. 70% to 130% of the known dimensional error may be specified, whereby this is in particular dependent upon the elasticity of the film and from the type and nature of the control circuit. Alternatively, it is provided that the degree of the positional correction of the first recognition means is limited by the dimensional error as the maximum value. Here, it is also possible for the correction to be performed in much smaller correction steps relative to the dimensional error in order gradually to approach the correct alignment.

Hereby, it is advantageous for the positioning method to be performed periodically with the period being longer than the processing time which passes while one repeat is conveyed from the first to the second detection means. If, in one control circuit, the control cycle is selected to be shorter when a first change has propagated itself in the system, then fluctuations or perturbations occur in the system and the desired result is not achieved. The control circuit must, therefore, have a certain "inertia" which in this case is determined by the distance between the two recognition means on the one hand and the mean rate of conveyance. The further development according to the invention ensures that a change is not ordered too prematurely again by the controller before the first correction is checked. Under some circumstances, this length may extend to the distance between the second recognition means from the brake, as there are new properties in this area.

Further features and advantages of the invention may be found in the dependent claims and in the following description of a preferred embodiment with reference to the drawing showing a packaging device according to the invention.

DESCRIPTION OF THE DRAWINGS

The sole FIGURE shows, in a stylised manner, a packaging device according to the invention in particular for the performance of the packaging method according to the invention.

DETAILED DESCRIPTION OF THE INVENTION

For the packaging of goods, a first web of film (bottom web) 1 is moved in the advance direction with troughs 8 being incorporated in this web of film 1 into which the goods are introduced. To seal these troughs 8, a second web of film (top web) 2 is withdrawn from a supply of web 3 and is placed on the first web 1 by means of deflecting rollers (not shown here) and then welded to the first web of film 1 by means of sealing, also not shown here, in a sealing station.

Usually imprints will be arranged on the second web of film 2, the imprints being divided into individual repeats 7 so that a repeat of this kind comes to lie on each of the troughs 8. These repeats usually have one imprint with which the goods are advertised/described and other necessary information concerning the content of the packaging container is provided. For, in particular optical, reasons of quality, it is desirable for the repeat 7 to be arranged exactly over the troughs 8 so that no part of the repeat 7 is cut off during the following cutting-out process. In the worst case, it is even possible that this could result in legally prescribed information being cut out thus rendering the goods unmarketable.

The packaging machine shown is a simple embodiment with usually several repeats 7 and troughs 8 being arranged in a row next to each other so that, for example, four packages may be produced simultaneously in one operational cycle.

The second web of film 2 is unrolled from the supply of web 3 by a withdrawing device whereby it is held tense by a brake 6. This tension ensures that the film arranged above the trough 8 is under tension and hence that a smooth, fold-free surface forms during the subsequent packaging. To be able to determine the position of the repeat 7 relative to the position of the trough 8, a first (optical) recognition means 4 is provided which, when the second web of film 2 is unwound from the supply of web 3, recognises control marks on the second web of film and reports the position of these control marks to a controller for the packaging machine.

The intrinsic elasticity of the film may cause it to happen that, despite this positional control, the repeat 7 does not come to lie exactly over the troughs 8. For this, the packaging device according to the invention has a second recognition means 5 which, upstream or downstream of the welding of the first web of film 1 with the second web of film 2, controls the position of the repeat again by means of control marks.

The drawing shows that the first recognition means 4 is held movably on a guide 10. The mobility is indicated by the double arrow 11, with this mobility being parallel to the direction of conveyance of the top web 2. In the example of an embodiment shown here, the recognition means 4 moves vertically, but the same arrangement is also possible in a horizontal or angled direction.

If the second recognition means 5 now detects an offset of the top web 2 relative to the bottom web 1 (this normally takes place in the controller 9 which is connected to the second recognition means 5 by the line 11), the controller 9 will activate the drive of the first recognition means 4 via the line 12 in such a way that the recognition means 4 is offset along the double arrow 11 in the direction specified by the controller. This means that the first recognition means 4 will detect the control marks on the top web 2 earlier or later and this is reported via the line 13 to the controller 9. Depending upon this information, the controller 9 will exert, via line 14, a regulating action on the brake 6 and close it or open it. This enables the repeat 7 to be positioned exactly. Since a rough presetting has already been performed by the first recognition means 4, the required length compensation will be kept within limits so that the image imprinted on the repeat 7 is optically changed only insignificantly by the stretching of the film. However, with the method suggested by the invention, self-adjustment is also possible in principle.

Control marks may be introduced auxiliary lines, optical defects which are selectively introduced into the film or even the repeat itself or edges of the films. In the case shown, the optical recognition means 4, 5 contain a light source and a photocell which detects the light from the light source reflected from the film and so identifies the passage of the control marks. Alternatively, a transmitted light measurement could also take place whereby the position of the web of film 1 may then also be reliably controlled.

In the case shown, the brake 6 is a simple friction brake, obviously a braking effect may also be achieved by braking the unrolling process of the supply of web 3. This would have the additional advantage that the repeat cannot be scratched or damaged in any other way as a result of friction processes due to the actuation of the brake.

The claims submitted now with the application and later are attempts at a formulation without prejudice for the achievement of further protection.

The relationships in the dependent claims refer to the further embodiment of the subject of the main claim by the features of the dependent claims in question. However, these should not be understood as a renunciation of the achievement of an independent subject-matter protection for the features of the related dependent claims.

Features which so far are only disclosed in the description may be claimed during the method as having a significance essential for the invention, for example to distinguish them from prior art.

What is claimed is:

1. A method for positioning webs of film of a packaging device, comprising:

introducing goods in troughs of a first web of film moving in an advance direction, withdrawing a second web of film from a supply of web against resistance of a brake and placing the withdrawn second web of film on the first web of film, bonding the first web of film with the second web of film, detecting an advance of the second web of film downstream of the supply of web by a first optical recognition means, setting the advance by varying the brake force of the brake in dependence on a signal from the recognition means so that in each case a repeat as a defined area of the second web of film comes to lie on the troughs of the first web of film, detecting an exact position of the repeat relative to the first web of film with a second recognition means, and changing the position of the first recognition means relative to a direction of conveyance of the second web of film in the event of dimensional errors.

2. The method for positioning webs of films of a packaging device according to claim 1, characterized in that the second web of film is provided with control marks which are recognized by the first recognition means and the second recognition means.

3. The method for positioning webs of films of a packaging device according to claim 1, characterized in that the first web of film and the second web of film are each provided with at least one control mark per repeat and in that the positional deviations of the control marks are determined by the second recognition means (5) so as to determine the position of the second web of film relative to the first web of film.

4. The method for positioning webs of films of a packaging device according to claim 1, characterized in that the position of the first web of film is determined by the second recognition means using a defined edge of the trough as a control edge, an optically detectable control edge.

5. The method for positioning webs of films of a packaging device according to claim 1, characterized in that a sealing station is provided to bond the first and second webs of film and the second recognition means arranged upstream or downstream of the sealing station.

6. The method for positioning webs of films of a packaging device according to claim 1, characterized in that the second web of film is bonded with the first web of film under tensile stress.

7. The method for positioning webs of films of a packaging device according to claim 1, characterized in that the size of the positional correction of the first recognition means substantially corresponds to the dimensional error determined by the second recognition means.

8. The method for positioning webs of films of a packaging device according to claim 1, characterized in that the size of the positional correction of the first recognition means is limited by the dimensional error as a maximum value.

9. The method for positioning webs of films of a packaging device according to claim 1, characterized in that the positioning method is performed periodically, with the period being longer than the processing time which passes while one repeat is conveyed from the first to the second detection means.

* * * * *